US006183182B1

(12) United States Patent
Baumgartner

(10) Patent No.: US 6,183,182 B1
(45) Date of Patent: Feb. 6, 2001

(54) DEVICE FOR FIXING INSULATING STRIPS

(75) Inventor: Stefan Baumgartner, Strongsville, OH (US)

(73) Assignee: SFS Industrie Holding, AG, Heerbrugg (CH)

( * ) Notice: Under 35 U.S.C. 154(b), the term of this patent shall be extended for 0 days.

(21) Appl. No.: 09/269,495

(22) PCT Filed: Sep. 26, 1997

(86) PCT No.: PCT/EP97/05298

§ 371 Date: Mar. 29, 1999

§ 102(e) Date: Mar. 29, 1999

(87) PCT Pub. No.: WO98/14675

PCT Pub. Date: Apr. 9, 1998

(30) Foreign Application Priority Data

Oct. 1, 1996 (DE) ..... 196 40 585

(51) Int. Cl.[7] ..... F16B 43/00; F16B 21/18

(52) U.S. Cl. ..... 411/533; 411/437; 411/526

(58) Field of Search ..... 411/361, 437, 411/531, 533, 545, 525, 526

(56) References Cited

U.S. PATENT DOCUMENTS

| | | | | |
|---|---|---|---|---|
| 4,781,503 | * | 11/1988 | Bogel | 411/533 X |
| 4,995,777 | * | 2/1991 | Warmington | 411/533 X |
| 5,207,535 | * | 5/1993 | Saab | 411/533 X |
| 5,908,278 | * | 6/1999 | Hasan et al. | 411/533 |

FOREIGN PATENT DOCUMENTS

| | | | | |
|---|---|---|---|---|
| 391699 | | 4/1989 | (DE) . | |
| 0 237 975 A3 | | 3/1987 | (EP) . | |
| 0 237 975 A2 | | 9/1987 | (EP) . | |
| 0 283 184 | | 3/1988 | (EP) . | |
| 0 535 547 A1 | | 4/1993 | (EP) . | |
| 1 325 317 | | 7/1963 | (FR) . | |
| 2090937 | * | 7/1982 | (GB) | 411/437 |
| WO 81/01436 | | 11/1980 | (WO) . | |
| WO 96 11311 | | 4/1996 | (WO) . | |

OTHER PUBLICATIONS

"isofest IF30, das sichere System (the secure system), printing reference BTF. Apr. 10, 1994.D".

DE–B: "Dubbel Taschenbuch fur den Maschinenbau (Dubbel Handbook of Mechanical Engineering), 15th edidtion, Berlin Heidelberg New York Tokyo, 1983, p. 959–961".

* cited by examiner

*Primary Examiner*—Neill Wilson
(74) *Attorney, Agent, or Firm*—Volpe and Koenig, P.C.

(57) ABSTRACT

In a fastening element (1) for fastening insulating sheets and if necessary sealing sheets to a solid base there are provided a screw (5) and a large-surface washer (6), wherein the screw (5) has a drilling point (7), a screw shank (9) provided at least partly with a threaded region (8) as well as a screw head (10). The washer has a central hole (21) for introducing the screw shank. A tubular extension (20) aligned axially parallel to the screw shank (9) to be inserted adjoins the central hole (21) in the washer (6). Sections or parts of this extension (20) engage by plastic deformation in the threaded region (8) of the screw shank (9) to achieve preassembled retention of the washer (6) and screw (5).

8 Claims, 4 Drawing Sheets

DEVICE FOR FIXING INSULATING STRIPS

BACKGROUND OF THE INVENTION

The invention relates to a fastening element for fastening insulating sheets or panels and if necessary additional sealing sheets to a solid base, said element comprising a screw and a large-surface metal washer, wherein the screw has a drilling point, a screw shank provided with a thread at least over part of its length and a screw head, and the washer has a preferably central hole for introducing the screw shank, wherein the washer can be preassembled at a distance from the screw head in the region of the screw shank such that it is secured against inadvertent axial shifting and wherein a tubular extension aligned axially parallel to the screw shank to be inserted adjoins the central hole in the washer, as well as to a method for preassembly of a large-surface washer in the threaded region of the screw shank of a screw so as to secure against inadvertent axial shifting.

Fastening elements of the type mentioned in the foregoing are known in many alternative embodiments (for example, U.S. Pat. No. 4,781,503 or EP A 0283184). In these embodiments, it is ensured that a large-surface washer is held directly in the region of the screw head or in a thread-free shank section disposed directly under the screw head so as to be secured against axial shifting. Thereby a certain degree of walking safety is supposedly achieved to the effect that if, in the use of fastening elements on roof surfaces, for example, persons walk on the insulating sheets or the sealing sheets laid thereover, the screw head is supposedly prevented from pushing through the sealing sheet to the outside due to such loading. In one known embodiment there is provided as the large-surface washer a plastic disk, which is braced against a circumferential collar formed on the screw shank. In another known embodiment there is provided a metal washer in which bracing takes place at the end of the threaded section adjacent to the screw head.

There are also known a fastening element and a device designed for driving this fastening element (U.S. Pat. No. 4,809,568), wherein this known fastening element comprises a screw and a washer made of plastic. The washer has in the central region, or in other words in the region of a hole provided to accommodate the screw shank, an elongated hub, so that the wall of the through hole can bear against the thread of the screw over a relatively long section. By dimensioning the hole in the washer to appropriate close tolerances, it can be ensured that the screw is pushed onto the thread in the manner of a fit, and in this position remains preassembled until finally set.

In practice, however, it is not universally possible to use plastic washers, especially in those sections of a roof where sealing is subsequently completed by a flame process. It is then imperative to use metal, large-surface washers. In order nevertheless to be able to achieve preassembly between washer and screw, and specifically at correspondingly large distance from the screw head, attempts have been made to inject in a relatively large central hole a plastic part, which has sufficient thickness viewed in axial direction that it can then bear against the screw over a certain threaded region, thus permitting preassembly in the form of a fit. It was soon realized that such an additional arrangement of a central plastic part in a metal washer is associated with enormous costs, which are unthinkable for a mass-produced article.

To be able to drive such fastening elements with a practical hand-held tool, it must be ensured that the large-surface washer is fixed on the screw shank at appropriately large distance from the screw head, since axial alignment of the screw is achieved while it is being driven, on the one hand by the fact that the screw head is engaged in the tool and on the other hand by the fact that the screw is guided at appropriate distance in the hole of the washer, so that at least two-point guidance is achieved until the screw point penetrates into the solid base. For this purpose it has already been proposed (German Patent Application DE A 4239339) that the hole in the washer must be made smaller than the threaded outside diameter on the screw shank, or at least as large as the core diameter of the threaded region. Thereby the washer can be preassembled in the threaded region of the screw shank at a distance from the screw head, so as to be secured against axial shifting. During preassembly, the screw is driven sufficiently far into the washer that the washer is disposed in the correct axial position relative to the screw head. It is precisely in screws with a relatively long thread, however, that the process of driving the screw practically through the disk is extremely time-consuming.

This disadvantage is also found in a fastening element of another known design (WO96/11311). After all, the tubular extension provided therein has an internal thread, which engages with the external thread of the screw. In addition to this, an adhesive can also be introduced. It is also possible, however, to fix the preassembled configuration exclusively by means of an adhesive. In one of the embodiments there are provided for this purpose a tubular extension without internal thread, a close fit between extension and screw, and an adhesive which fills the extension. The first-cited embodiment, in which screw and extension are in mutual threaded engagement, has the further disadvantage that the internal thread of the extension must be made by thread grooving or thread cuffing, which represents a major expense in a mass-produced article such as the fastening element in question here. Furthermore, the extension must have large material thickness to ensure that thread grooving or thread cutting is possible at all. Finally, this thread-grooving or thread-cuffing operation must be accomplished in a separate, additional working sequence, and only thereafter will the washer be united with the screw, by driving the latter sufficiently far into the washer. All this means increased time requirements, which must also be added to the time requirement for driving the screw into the washer. Moreover, the thread of the screw and the thread of the washer must lie within certain tolerances to ensure that the thread surfaces of surface-treated screws and washers will not be damaged during the driving process.

Accordingly, it is the object of the invention to provide a fastening element of the type indicated in the introduction, in which optimal preassembly can be achieved in a short time and with little working effort.

BRIEF SUMMARY OF THE INVENTION

According to the invention, it is proposed that sections or parts of the extension be plastically deformed into the threaded region of the screw shank by point-like or slot-like radial indentations in order to retain the screw inserted in the washer.

In the fastening element according to the invention, therefore, it is not necessary to make any threads before preassembly. It is sufficient to unite washer and screw in the desired preassembly position and then make the radial indentations into the threaded region of the screw shank from the outside. The screw thread thus constitutes a shaping tool during plastic deformation of the extension. However, the indentations do not constitute a continuous thread.

Instead, the plastically deformed metal of the extension extends into the thread turns of the screw only at various points on the circumference, thus simulating an internal thread of the extension. This positive connection between washer and screw is sufficient for preassembly, and can be achieved with less time consumption and lower costs than the threaded engagement or adhesive filling in a known embodiment.

By virtue of the design according to the invention, automation of preassembly has also been made possible, since both the process of pushing the washer onto the screw shank and that of radial deformation can be preprogrammed in a specified working sequence.

In a further alternative embodiment, the tubular extension is formed by a plurality of tabs bent over during the process of stamping the central hole in the washer. The hole and the extension adjoining it are thereby endowed with polygonal cross section, while the two ends of the bent-over tabs usually taper in the form of pointed elements. In such an embodiment, it is possible for sections or parts of this extension to be pressed into the threaded region of the screw shank or else the free ends of these bent-over tabs can be bent toward the threaded region.

A further variant is achieved when the tubular extension has the form of a tubular part inserted positively and/or nonpositively into the central hole of the washer and if necessary is provided with a stop. Thereby the extension can be made in practice as a part separated from the washer. Thereafter these two regions can be simply plugged together. The size of the actual hole is then increased just enough to accommodate the tubular part to be inserted, while the inside diameter of the tubular part is again matched to the threaded region of the screw shank.

Further advantages are achieved in precisely such a design. For example, it can be provided that the tubular part to be inserted positively or nonpositively into the hole of the washer is made of metal or plastic. On the one hand, a metal part or a plastic part can therefore be used as necessary, while on the other hand there are achieved thereby various options for the subsequent squeezing step and thus for exact preassembly between washer and screw.

It is further proposed that the tubular extension be provided with a length extending over at least one thread pitch of the threaded region of the screw shank. Thereby it is guaranteed, by virtue of the provided stop, that the disk will not tilt relative to the screw axis and therefore that it can hardly occupy a skewed orientation relative to the screw.

According to an alternative embodiment it is provided that the point-like or slot-like indentations are similar to knurling. As a result the most diverse design options are possible, and so different options for ensuring secure retention of the positional relationship between washer and screw by means of subsequent deformation are available depending on application and depending on existing equipment.

The method according to the invention for preassembly of a large-surface washer in the threaded region of the screw shank of a screw so as to secure it against inadvertent axial shifting provides that the screw is loosely introduced into the central hole in the washer until the washer is disposed at the desired distance from the head of the screw, and that thereafter the tubular extension formed or inserted in the region of the central hole of the washer is squeezed radially inward in point-like or slotlike manner by local application of radial force to achieve plastic deformation at least of partial sections of the extension toward the threaded region of the screw shank.

According to the present invention, it is on the one hand a very simple matter to push the washer onto the screw shank without damaging surface sections of the two parts of the fasting element, while on the other hand secure preassembly is achieved by the subsequent deformation of the provided tubular extension. The method can be performed effortlessly and safely, achieving an optimum in simple and inexpensive process steps.

BRIEF DESCRIPTION OF THE SEVERAL VIEWS OF THE DRAWINGS

Further advantages will be explained in more detail in the following description with reference to the drawing, wherein.

DETAILED DESCRIPTION OF THE PREFERRED EMBODIMENTS

Figure 1:
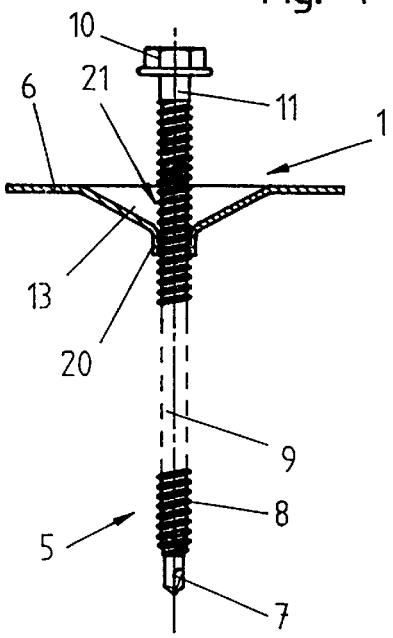
FIG. 1 shows a fastening element according to the invention, wherein the washer is illustrated in section and in a preassembly position.

Fastening element 1 is used substantially for fastening insulating sheets 2 or corresponding panels (FIG. 1) or insulating sheets 2 and additional sealing sheets 3 to a solid base 4. Fastening element 1 itself comprises a screw 5 and a large-surface metal washer 6. Screw 5 has a drilling point 7, a screw shank 9 provided over at least part of its length with a thread 8, and a screw head 10. Thread 8 can be continuous practically over the entire length of screw shank 9, a thread-free shank section 11 being advantageously provided at least underneath screw head 10, so that the walking safety already achieved heretofore in such arrangements is then additionally ensured when the washer is stressed. It would also be conceivable for thread 8 to extend over a correspondingly shorter region of the length of screw shank 9. A thread 8 is necessary at least adjacent to drilling point 7, in order to achieve fastening in solid base 4.

Washer 6 is provided with a central hole, which is disposed at the center of a conical countersunk pocket 13. By virtue of this countersunk pocket 13, screw head 10 can be disposed in countersunk position after the fastening element has been finally screwed down, and so there is no danger of damage to the further sealing sheet to be laid thereover. The washer can have approximately square shape with rounded corners. It is naturally also conceivable to use the provisions according to the invention for washers of other shape. In doing so it is immaterial whether the surface of such a washer is smooth or provided with appropriate reinforcing ribs or depressions. It is also possible to use a washer which is not provided in the region of hole 21 with a countersunk pocket 13, in which case the washer sections present laterally adjacent to hole 21 are plane. In this case it would also be conceivable for upwardly directed reinforcing ribs to be provided following the plane sections, so that appropriate countersunk disposition of the screw head is then again ensured relative to the uppermost surface of the washer. The form according to the invention is also possible when the washer is curved for purposes such as reinforcement.

According to the present invention, there is now provided adjoining central hole 21 a tubular extension 20, which is aligned axially parallel to screw shank 9 to be inserted. From the diagram in FIGS. 2 and 2*a* it is also evident that inside diameter D2 of tubular extension 20 is as large as or somewhat larger than outside diameter D1 of threaded region 8 of screw shank 9. Thus screw shank 9 can be pushed simply and without resistance into hole 21 or extension 20 adjoining it. Thereby damage to regions of the screw and washer which may be surface-coated cannot occur.

Figure 2:
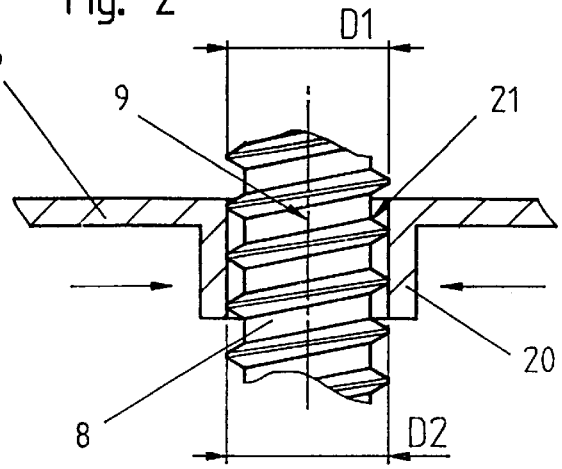
FIG. 2 and FIG. 2*a* show an enlarged diagram of a section of a screw and of a washer, wherein the washer is illustrated in section in FIG. 2 and in side view in FIG. 2*a;*
Figure 2A:
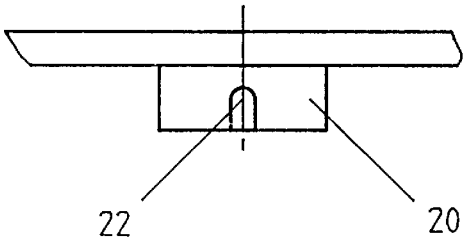

In FIG. 2*a* it is evident that indentations 22 are provided in tubular extension 20. Once washer 6 is disposed in correct position (see FIG. 1) relative to screw head 10, the washer is fixed in this desired preassembly position by squeezing extension 20 against threaded region 8 of screw shank 9 by radially pressing in sections or parts of extension 20, so that the regions disposed inside tubular extension 20 engage in threaded region 8. As a result, plastic deformation of sections or parts of extension 20 takes place, thus ensuring positionally secure preassembly of washer 6 and screw 5 as a corresponding fastening element 1.

In the embodiment according to FIGS. 2 and 2*a*, extension 20 has the form of a circumferentially closed tubular piece and is integral with washer 6. Extension 20 thus directly adjoins hole 21 and can be made in one working sequence such as the process of stamping and forming washer 6. From the practical viewpoint, therefore, this region of extension 20 is downwardly formed in a deep-drawing process.

Figure 3:
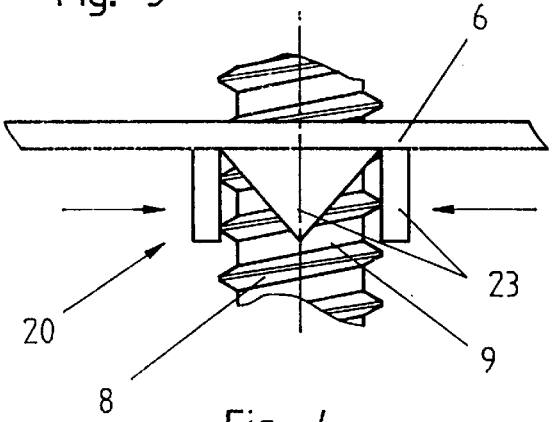
FIG. 3 shows another form of an extension on a washer, in which a screw is inserted.
Figure 4:
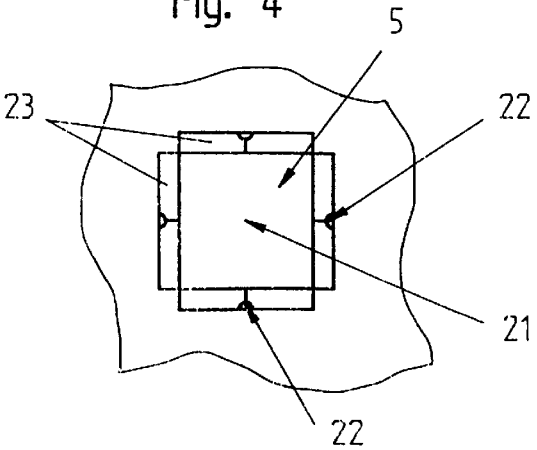
FIG. 4 shows a view of the washer from above.
Figure 5:
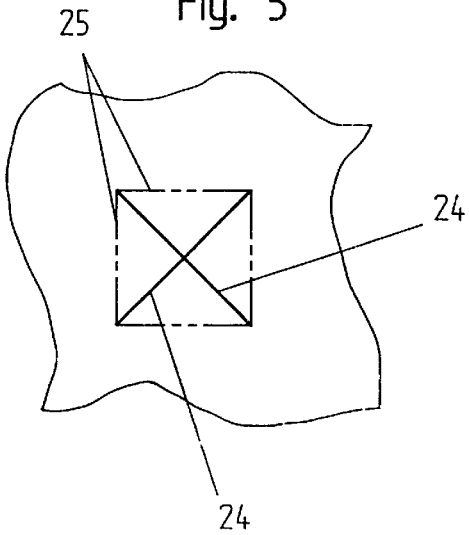
FIG. 5 shows a view of the washer according to FIGS. 3 and 4 from above, but in this case only the punched parting lines and punched bending lines are indicated.
Figure 6:
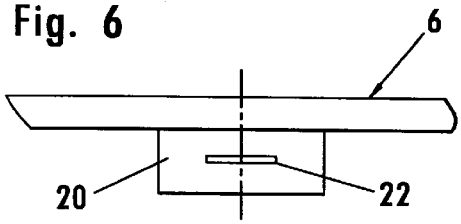
FIG. 6 to FIG. 16 show different alternative embodiments with regard to the plastic deformation of sections or parts of the extension on a washer.
Figure 7:
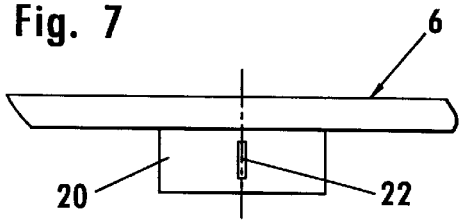
Figure 8:
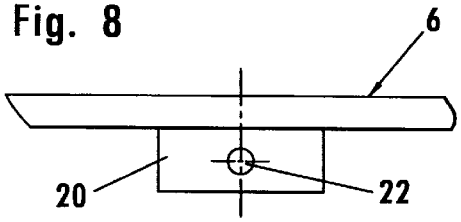
Figure 9:
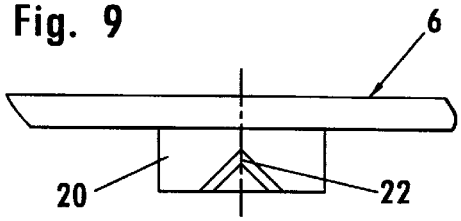
Figure 10:
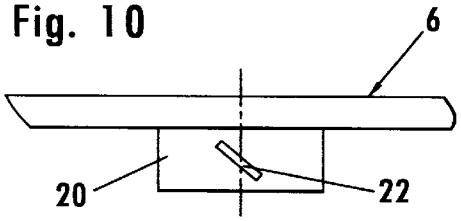
Figure 11:
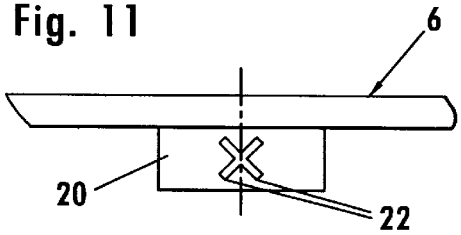
Figure 12:
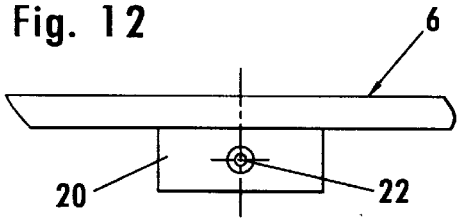
Figure 13:
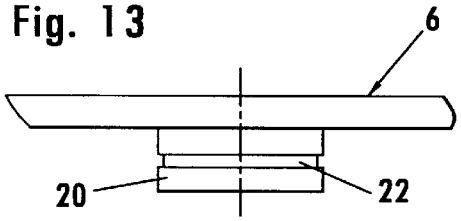
Figure 14:
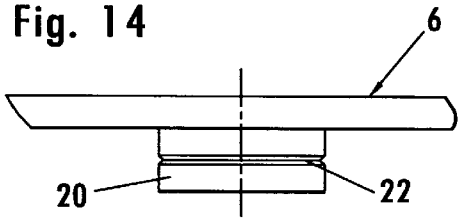
Figure 15:
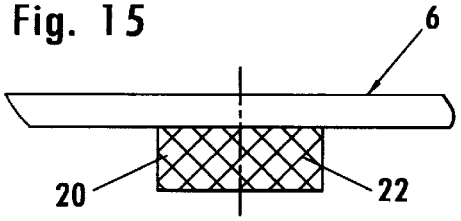
Figure 16:
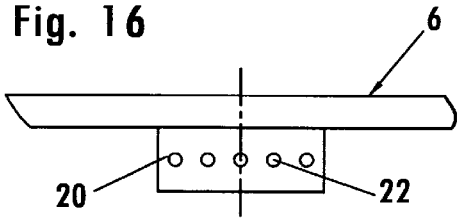

In the embodiment according to FIGS. 3 to 5, tubular extension 20 is formed by a plurality of tabs 23 bent over during the process of stamping central hole 21 in washer 6. In the embodiment shown here a square hole 21 is obtained thereby, the side boundaries of this hole 21 being four downwardly bent tabs 23 which taper downward to points. Appropriate indentations 22 can also be provided in such an embodiment, so that sections or parts of extension 20 can be squeezed against threaded region 8 of screw shank 9. In this connection, it would also be conceivable, however, for only the end regions of these tabs 23 freely projecting downward to be bent over in plastically deformed condition in an appropriate process, so that the free end regions then engage in threaded region 8. FIG. 5 shows how the individual tabs 23 are made by parting cuts 24 and by bending over along bending lines 25.

Figure 20:
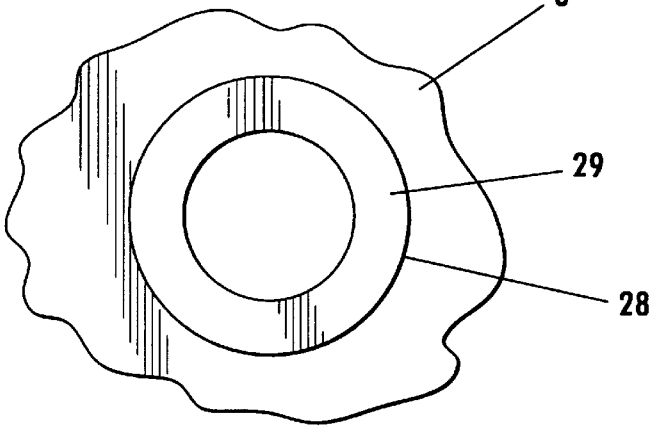
FIG. 20 is a top plan view of FIG. 19 in which the screw has been removed for clarity.
Figure 19:
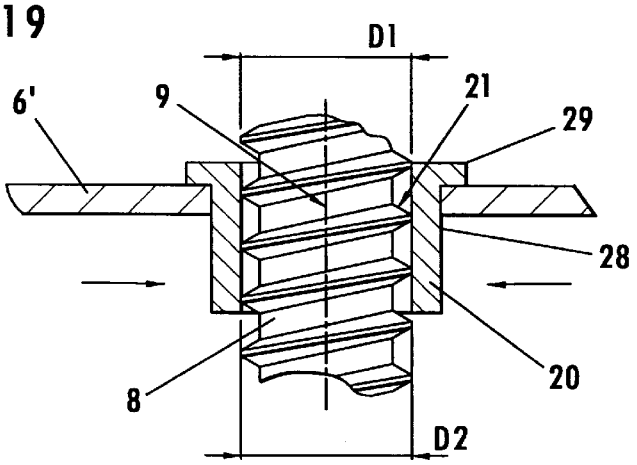
FIG. 19 shows an enlarged diagram of a section of a screw and a washer having a separate tubular part, wherein the separate tubular part and washer are illustrated in section.
Figure 21:
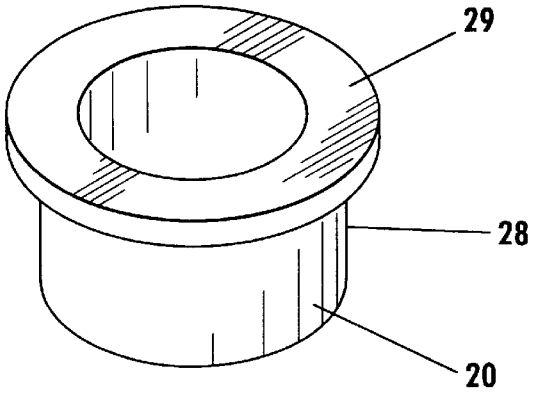
FIG. 21 is an isometric view of the separate tubular part shown in FIG. 19.

Referring now to FIGS. 19–21, an alternate embodiment of the invention is shown in which an appropriate hole is provided in washer 6' into which a tubular part 28 provided if necessary with a stop, such as a flange 29, is inserted. Washer 6' would then be made merely as a stamped part, without the need for regions to be downwardly deformed or bent over to form extension 20. In such an embodiment, it is additionally conceivable to use tubular parts of metal or of plastic, which can then be deformed as needed. It would also be possible in such an embodiment to use special metals or special plastics, in order thereby to create additional effects or additional protection, specifically with regard to corrosion at the interface between washer 6' and screw 5.

Especially from the diagrams according to FIGS. 2 and 3 it is obvious that tubular extension 20 has a length which corresponds at least to one thread pitch of threaded region 8 of screw shank 9. Thereby the risk of tilting of washer 6 relative to screw shank 9 is largely ruled out, with advantageous consequences which in particular also extend to subsequent transportation of the preassembled fastening elements.

FIGS. 6 to 16 show the most diverse options for deformation of extension 20 by point-like or slot-like radial indentations. Various ways in which such indentations can be disposed are demonstrated here.

Also conceivable are indentations disposed around a circular circumference or even indentations resembling knurling. The slot-like indentations can be disposed perpendicular, parallel or even at an angle to the direction of the axis of the screw to be inserted, or if necessary can have the form of crosses. The options demonstrated here are in no way a complete enumeration. The purpose merely is to indicate that a multiplicity of variants is available for the manner in which tubular extension 20 formed or inserted in the region of central hole 21 of washer 6 can now be squeezed against threaded region 8 of screw shank 9 by application of radial force locally or over the entire surface to cause plastic deformation at least of partial sections of extension 20.

Figure 17:
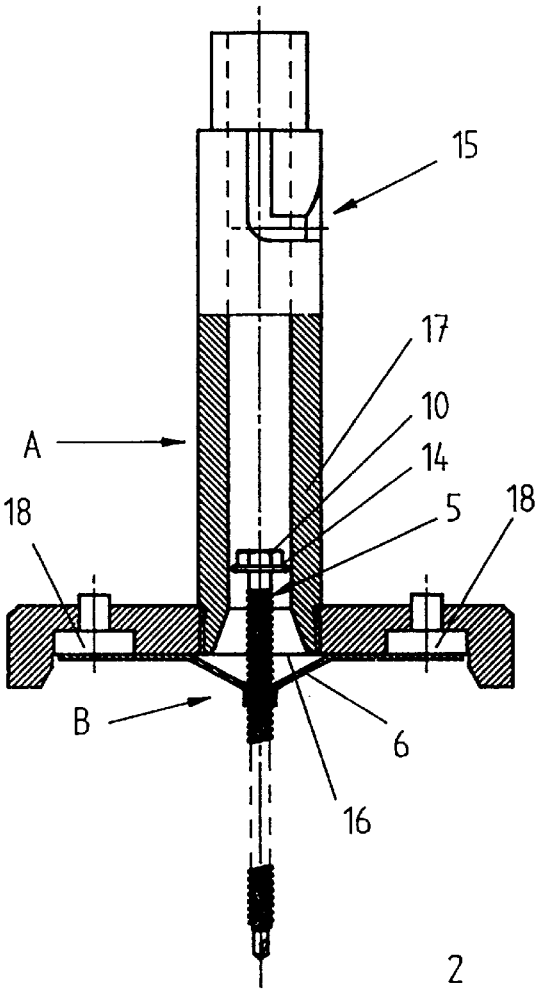
FIG. 17 shows a device for driving a fastening element, illustrated partly in section, with fastening element inserted.

Depending on the design of the device for driving the fastening element, it is expedient for preassembly of washer 6 to be effected at constant distance from screw head 10. Screw head 10 then always protrudes to the same extent into the corresponding device, and so the capabilities for axially precise alignment during the driving process are always the same. FIG. 17 illustrates a device 15 for driving a fastening element 1. This device is provided with a bracing face 16, against which washer 6 can bear. There is also provided a housing tube 17, into which the head end of screw 5 can be inserted. Device 15 can be coupled to an appropriate assembly arrangement with a driving element. From this same FIG. 6 it is evident that axially precise alignment of the fastening element is possible by cooperation with screw head 10 and washer 6. In other words, regions A and B permit axially precise alignment of screw 5.

To ensure that fastening element 1 can be retained appropriately in secure position on device 15, permanent magnets 18 can be provided in the region of bracing face 16.

Figure 18:
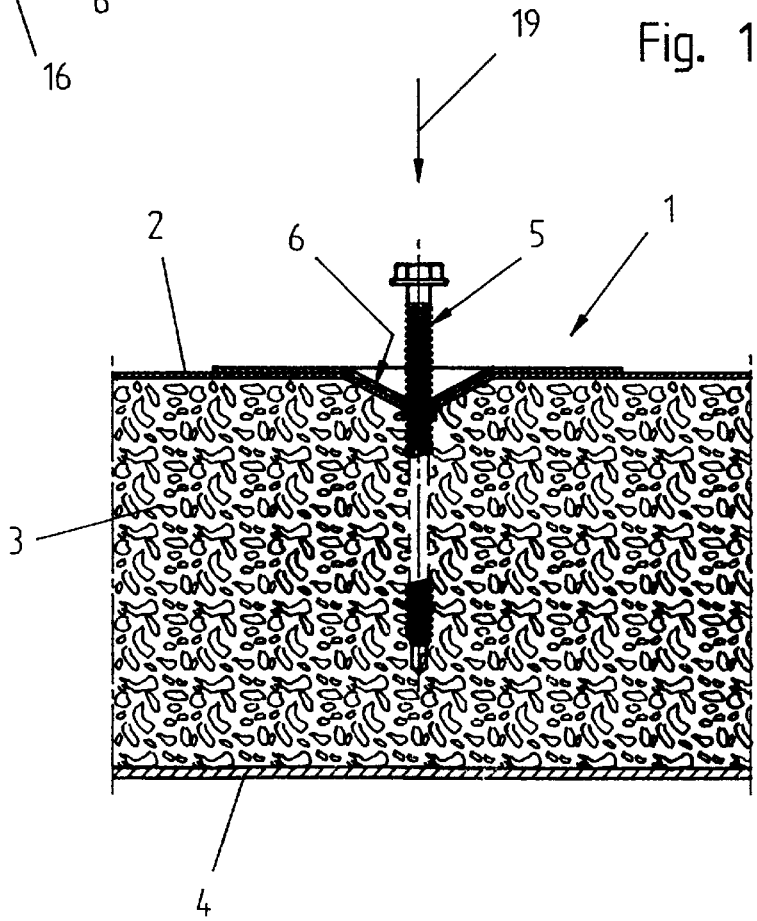
FIG. 18 shows another option for setting the fastening element, wherein the fastening elements in this case are first pushed in manually and then the screws are driven with the device.

In practice, the procedure for assembly of fastening elements is frequently one in which they are manually pressed through sealing sheets 2 into insulating sheets 3 at the appropriate spacings. This can be seen from FIG. 18. After this pressing-in operation, device 15 is placed on top in the direction of arrow 19, and all that remains is now to drive screw 5 appropriately. Nevertheless, washer 6 performs the function of second guide section B here also, and so washer 6 even in this case bears against bracing face 16, but no longer has to be held by permanent magnets 18 to protect it from being lost. The very act of preassembly of the fastening element in a manner in which the washer is disposed at the appropriate distance from screw head 10 is practical even for inserting the fastening elements manually, not to mention for the subsequently necessary operation of assembly by the device. The fastening element can then be grasped in the region of screw head 10 and inserted into the base in specified manner.

In the foregoing description, reference was made to hole 21 in washer 6 and to the diameter of this hole. Naturally it is also possible to provide holes of different shapes instead of a circular hole. Thus it would also be conceivable to make this hole polygonal, or in other words triangular, square or hexagonal, for example, in which case the corresponding sizes (diameter sizes) relate to a corresponding envelope circle. The shape of the washer can also be adapted to the most diverse circumstances, in which connection it is conceivable in principle to use both polygonal washers and washers which appear round or oval in top view. Even screw head 10 can be given diverse shape and form, and so it would even be entirely possible to provide a socket drive or in principle a different tool-specific drive instead of an external hexagon drive. To ensure more exact guidance of screw head 10 in housing tube 17, it would be conceivable to adapt collar 14 more exactly to the inside diameter of this housing tube 17.

By virtue of the present invention there has been created a further improved, inexpensive fastening system for small and medium-sized flat roofs, although the fastening element can of course also be used in wall regions and in indoor regions such as ceilings. Streamlined assembly with preassembled fastening elements is possible, and preliminary insertion of the fastening elements into roof surfaces can also be achieved in the same way.

What is claimed is:

1. A fastening element for fastening insulating sheets or panels to a solid base, said element comprising a screw (5) and a large-surface metal washer (6), wherein the screw (5) has a drilling point, a screw shank provided with a thread at least over part of its length and a screw head, and the washer has a hole (21) for introducing the screw shank (9), wherein the washer (6) is preassembled at a distance from the screw head in a region of the screw shank (9) such that it is secured against inadvertent axial shifting and wherein a tubular extension (20) aligned axially parallel to the screw shank (9) to be inserted adjoins the central hole (21) in the washer (6), at least a portion of the extension (20) is plastically deformed into the threaded region (8) of the screw shank (9) by point-like or slot-like radial indentations (22) in order to retain the screw (5) in position in the washer (6).

2. A fastening element according to claim 1, characterized in that the tubular extension (20) is formed by a plurality of tabs (23) bent over during stamping of the central hole (21) in the washer (6).

3. A fastening element according to claim 1, characterized in that the tubular extension (20) comprises a tubular part inserted at least one of positively or nonpositively into the central hole (21) of the washer (6).

4. A fastening element according to claim 3, characterized in that the tubular part to be inserted positively or nonpositively into the hole (21) of the washer (6) is made of metal or plastic.

5. A fastening element according to claim 3, characterized in that a stop is provided on the tubular part.

6. A fastening element according to claim 1, characterized in that the tubular extension (20) is provided with a length extending over at least one thread pitch of the threaded region (8) of the screw shank (9).

7. A fastening element according to claim 1, characterized in that the point-like or slot-like indentations (22) are similar to knurling.

8. A method for preassembly of a large-surface washer in a threaded region of a screw shank of a screw so as to secure against inadvertent axial shifting, comprising loosely introducing the screw (5) into a central hole (21) in the washer (6) until the washer (6) is disposed at a desired distance from the head (10) of the screw (5), and thereafter squeezing, radially inward in point-like or slot-like manner on a tubular extension (20) formed or inserted in a region of the central hole (21) of the washer (6) by local application of radial force to achieve plastic deformation of at least partial sections of the extension (20) toward the threaded region (8) of the screw shank (9).

* * * * *